US009067335B2

(12) United States Patent
Dulaney

(10) Patent No.: US 9,067,335 B2
(45) Date of Patent: Jun. 30, 2015

(54) RESILIENT FINGER SCRAP STRIPPER FOR CORRUGATED BOARD ROTARY CUTTING DIE

(75) Inventor: Ronald Carl Dulaney, Ceres, CA (US)

(73) Assignee: Container Graphics Corporation, Cary, NC (US)

( * ) Notice: Subject to any disclaimer, the term of this patent is extended or adjusted under 35 U.S.C. 154(b) by 235 days.

(21) Appl. No.: 13/569,533

(22) Filed: Aug. 8, 2012

(65) Prior Publication Data

US 2014/0041493 A1 Feb. 13, 2014

(51) Int. Cl.
*B26D 7/18* (2006.01)
*B26F 1/38* (2006.01)

(52) U.S. Cl.
CPC ..... *B26F 1/384* (2013.01); *Y10T 83/9312* (2015.04); *Y10T 83/04* (2015.04); *B26D 7/1818* (2013.01); *Y10T 83/2133* (2015.04); *Y10T 83/2109* (2015.04); *B26D 2007/1809* (2013.01)

(58) Field of Classification Search
CPC ..... B26F 1/384; B26F 7/18; B26F 1/08; B26D 7/1818; B26D 2007/1809
USPC ..... 83/110–117, 27, 128
See application file for complete search history.

(56) References Cited

U.S. PATENT DOCUMENTS

| | | | | |
|---|---|---|---|---|
| 4,499,802 | A * | 2/1985 | Simpson | 83/117 |
| 5,111,725 | A * | 5/1992 | Simpson et al. | 83/117 |
| 5,636,559 | A * | 6/1997 | Smithwick et al. | 83/116 |
| 5,701,789 | A * | 12/1997 | Okonski | 83/13 |
| 6,966,245 | B1 * | 11/2005 | Simpson | 83/27 |
| 7,017,463 | B1 * | 3/2006 | Simpson | 83/117 |
| 7,111,534 | B1 | 9/2006 | Simpson | |
| 2011/0265620 | A1 * | 11/2011 | Kicinski et al. | 83/27 |

* cited by examiner

*Primary Examiner* — Kenneth E. Peterson
*Assistant Examiner* — Nhat Chieu Do
(74) *Attorney, Agent, or Firm* — Coats and Bennett, PLLC

(57) ABSTRACT

An apparatus configured to cooperate with a rotating anvil to cut corrugated board comprises a rotary cutting die configured to rotate in one direction and to cooperate with the anvil to cut corrugated board. The cutting die includes a base and at least one scrap cutting blade and a scrap stripper that comprises one or more fingers that project from the base at an incline and which is slanted forwardly in the direction of rotation of the cutting die for stripping cut scrap pieces of corrugated board from the blade.

9 Claims, 7 Drawing Sheets

RESILIENT FINGER SCRAP STRIPPER FOR CORRUGATED BOARD ROTARY CUTTING DIE

FIELD OF THE INVENTION

The present invention relates to corrugated board rotary cutting dies, and more particularly to a finger-type scrap stripper forming a part of the die.

BACKGROUND OF THE INVENTION

Rotary cutting dies are used for producing a container or carton blank from corrugated board sheet material. These rotary cutting dies basically comprise a pair of cooperating cylinders. One of the cylinders, a cutting cylinder, includes a die board or base having cutting blades or rules while the other, the anvil cylinder, provides a backing surface against which the cut or score is made.

In the process of die cutting sheets of corrugated board, scrap is produced. The scrap may comprise outside trim cut from the sheet of corrugated board or it may comprise interior material cut from the final product, such as holes or slots. Because of the presence of cut pieces of scrap that occur during the process of performing work on a sheet of corrugated board, provisions for removing or stripping the scrap material from certain blades and the product board must be provided. If there is a failure of stripping or removing the cut scrap, the scrap material tends to collect around the cutting blade and can render the rotary cutting die inoperable. In addition, it is important to remove the cut scrap such that it does not become integrated with the produced corrugated board product.

It is known to use finger-type scrap strippers. See U.S. Pat. No. 7,111,534. These resilient and compressible fingers are attached to the die board of the rotary cutting die and project therefrom. They are, however, rearwardly angled, meaning that they are inclined or slanted in a direction opposite the direction of rotation of the rotary cutting die. That is, their orientation on the rotary cutting die is such that just before entering the nip between the rotary cutting die and the anvil, the fingers generally project rearwardly, again in a direction generally opposite to the direction of rotation of the rotary cutting die.

In recent years, it has become important for rotary cutting dies to operate more efficiently. That is, it has become important for rotary cutting dies to run at relatively high speeds and produce more product per hour than has been customary in the past. This is challenging for a number of reasons. One of the challenges is dealing with cut pieces of scrap at these high operating speeds. In some cases, the traditional rearwardly angled finger-type scrap strippers are not able to strip and move the cut pieces of scrap away from the rotary cutting die at these high speeds.

Therefore, there has been and continues to be a need for a rotary cutting die having a scrap stripping mechanism that is effective at high operating speeds.

SUMMARY OF THE INVENTION

The present invention entails a rotary cutting die having one or more finger type scrap strippers where the finger is forwardly angled, that is slanted or inclined in the direction of rotation of the rotary cutting die.

In one embodiment, the finger scrap stripper includes an elongated piece of resilient and compressible material having a base and a series of spaced apart fingers projecting from the base. When the base and fingers are secured to the rotary cutting die, the fingers are oriented such that they are at least slightly angled forwardly when in the disengaged or non-compressed position. In another embodiment, the finger scrap stripper entails a single finger projecting from a base. Like the multi-finger embodiment, the finger in a disengaged and non-compressed position projects such that it is angled forwardly with respect to the direction of rotation of the rotary cutting die.

DESCRIPTION OF EXEMPLARY EMBODIMENTS

Figure 1:
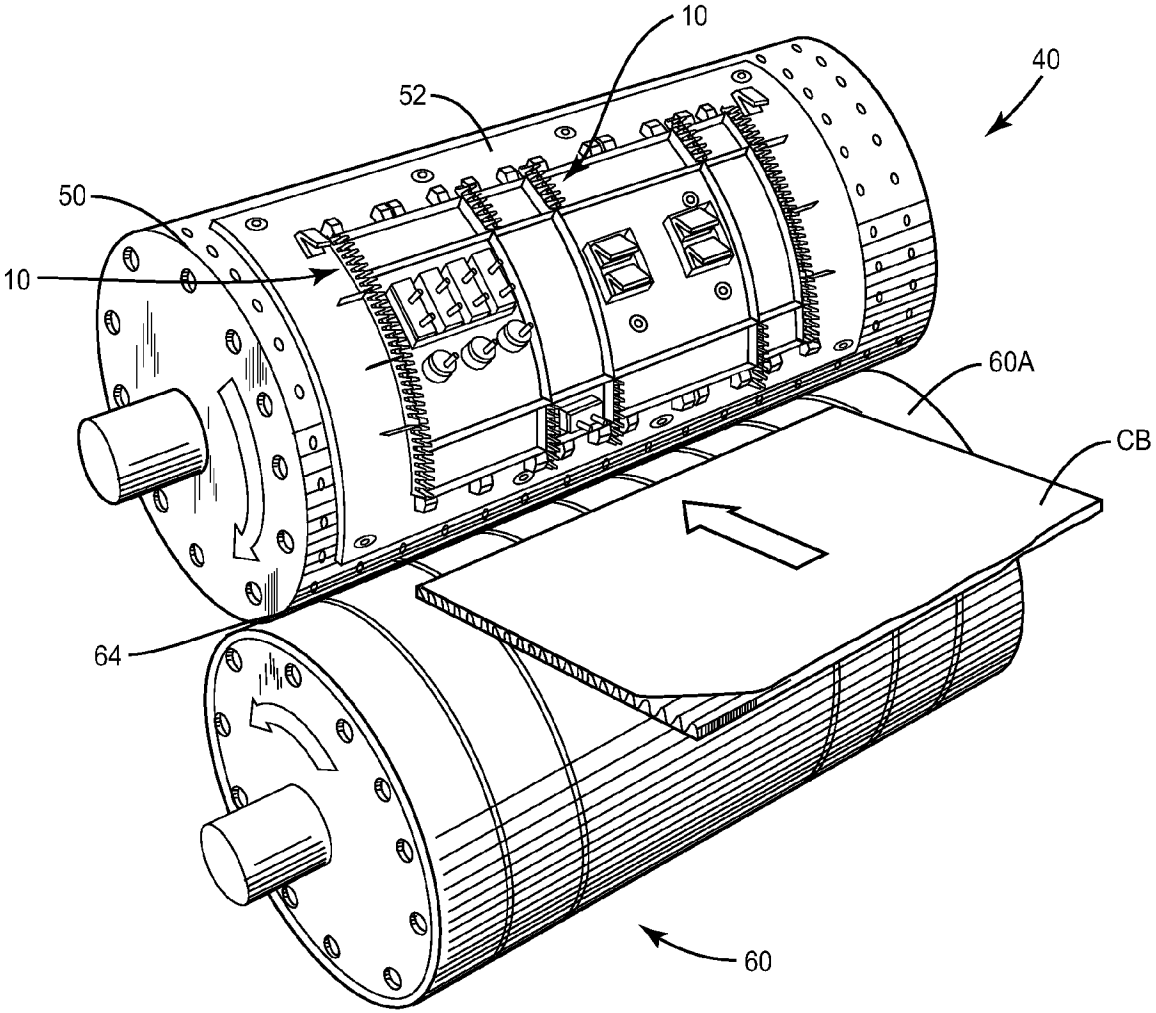
FIG. 1 is a perspective view of a corrugated board rotary die cutting apparatus which incorporates resilient scrap strippers of the type contemplated by the present invention.
Figure 2:
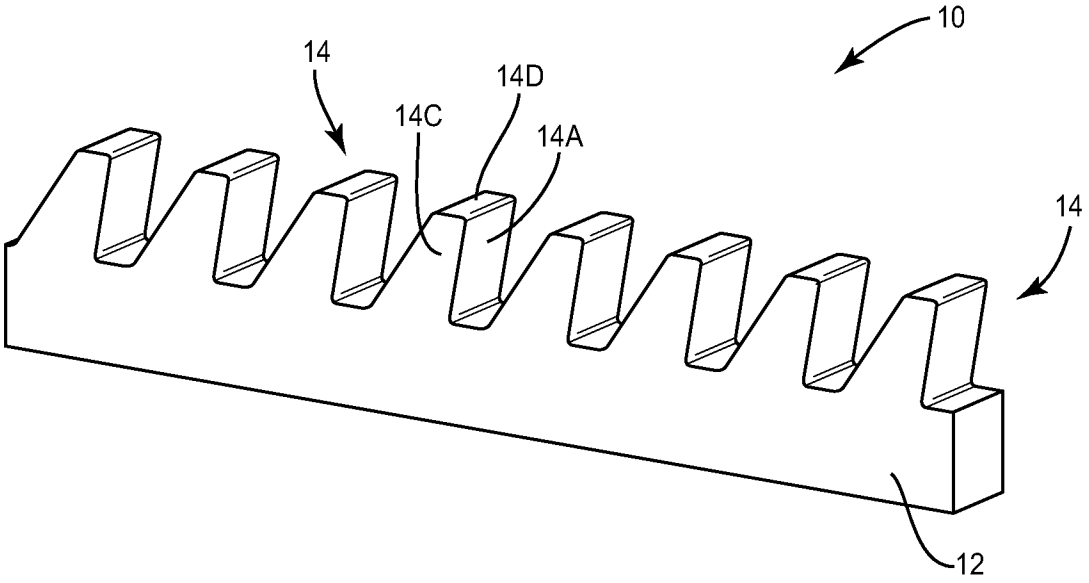
FIG. 2 is a perspective view of one embodiment of the scrap stripper.
Figure 3:
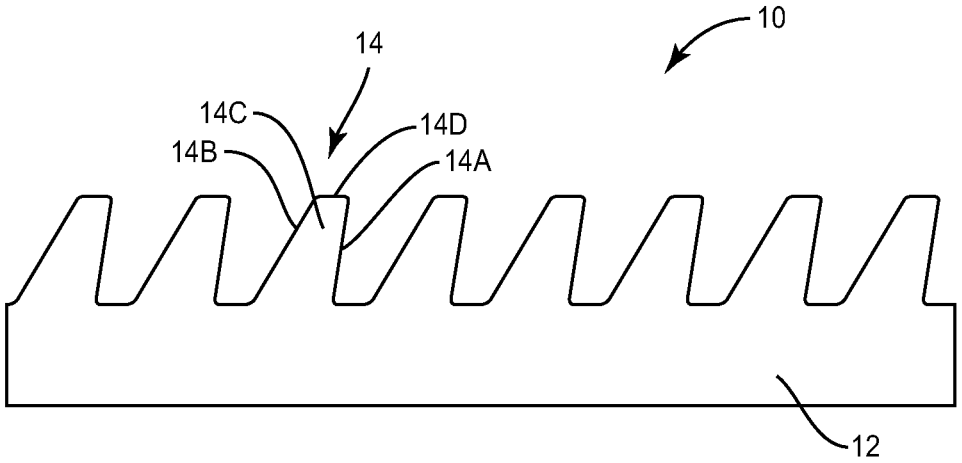
FIG. 3 is a side elevational view of one embodiment of the scrap stripper.

With further reference to the drawings, FIG. 1 illustrates a rotary die cutting apparatus indicated generally by the numeral 40 for cutting corrugated board CB. The rotary die cutting apparatus 10 basically comprises a pair of rotatably mounted cooperating cylinders or drums. The assembly includes a cutting cylinder 50 and an anvil cylinder 60. Cutting cylinder 50 is at least partially surrounded or sheathed with a generally cylindrical die board of base 52. Secured around the anvil 60 in conventional fashion is a layer of EPDM or polyurethane foam elastomer rubber 60A or other suitable material, against which the rotary cutting die cuts.

Typically the cutting cylinder 50 and anvil 60 are disposed closely adjacent each other so as to define a nip or nip area 64 between the cylinder and anvil. In a conventional corrugated board die cutting operation, the cutting cylinder 50 and the anvil 60 are driven at close to the same speed and sheets of corrugated board CB are fed through the nip 64. As a corrugated board CB is fed through the nip, the rotary die cutting apparatus 10 cuts through the corrugated board and against the outer circumferential sheet of EPDM or polyurethane foam elastomer rubber 60A secured to the anvil cylinder 60. Thus in conventional fashion the sheets of corrugated board CB are cut, trimmed, scored, slitted, etc. so as to produce a sheet or blank of corrugated finished board, sometimes referred to as the diecut product, and cut scrap which is cut from the original corrugated board CB.

In order to produce the corrugated diecut product, the rotary cutting die board 52 is typically provided with a series of knives or blades and scoring rules that trim, cut and score selective areas of the corrugated board CB fed into and through the nip 64. Note in FIG. 1, for example, that the cylindrical die board 52 includes various blades and/or scoring rules. In addition, the die board 52 includes various scrap strippers that are employed to strip scrap pieces of corrugated board from blades and to direct the cut scrap pieces away from the product board. Cut scrap can take on various forms. There is basically two types of scrap cut from the corrugated board CB in this process. One type of scrap is trim that is trimmed from edges of the original corrugated board CB fed into the rotary die cutting apparatus 40. There is also scrap that is actually cut from the resulting product board. This scrap can include scrap that forms holes or slots, for example, in the product board. As used herein, the term "scrap" refers to both trim scrap and scrap cut from the resulting product board. In addition, the die board 52 may include product ejectors. As discussed above, the scrap stripper or strippers disclosed herein typically function to strip scrap from adjacently disposed blades. Further, the scrap strippers function to engage and direct the cut pieces of scrap S away from the rotary cutting die apparatus 40 so as to efficiently separate the cut scrap S from the product board. See FIGS. 5D and 5E.

Figure 6:
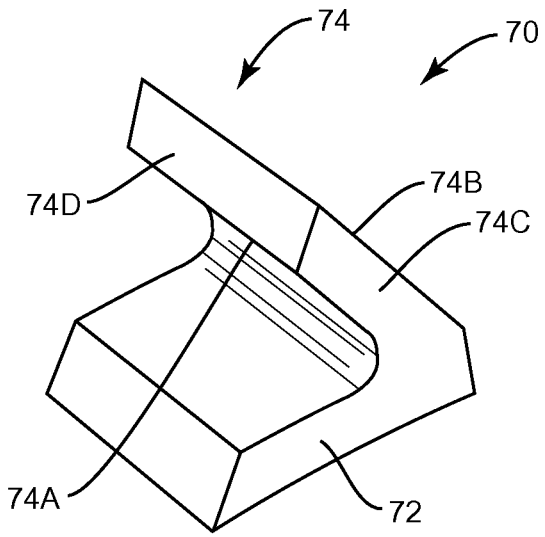
FIG. 6 is a perspective view of an alternate design of the scrap stripper.
Figure 7:
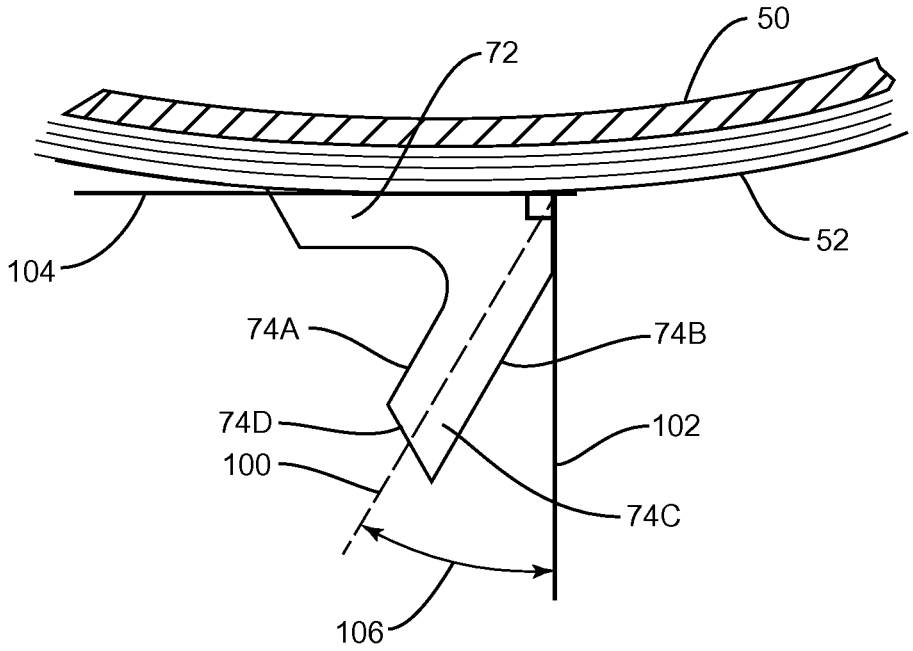
FIG. 7 is a fragmentary sectional view showing how the scrap stripper of FIG. 6 is mounted to the base or die board of the rotary cutting die and particularly illustrates the forwardly inclined angle formed by the finger of the scrap stripper relative to a normal reference line.

Disclosed herein is two embodiments for the scrap stripper employed in the rotary die cutting apparatus 40 of the present invention. The first embodiment is shown in FIGS. 2-5. The second embodiment is shown in FIGS. 6 and 7.

With respect to the first embodiment shown in FIGS. 2-5, the scrap stripper is indicated generally by the numeral 10. As seen in the drawings, the scrap stripper comprises an elongated piece of resilient and compressible material that includes a base 12 and a series of angled fingers 14 projecting away from the base. Each finger includes a leading end 14A, a trailing end 14B, a pair of sides 14C and an outer end 14D. See FIGS. 2 and 4. As noted above, the stripper 10 is typically constructed of resilient and compressible material. The stripper is typically manufactured of 80-90 Shore OO elastomer, such as polyurethane foam. It should be pointed out, however, that other existing materials that are resilient and compressible can be used. In one embodiment, it has been found that material with a durometer of approximately 55-90 Shore OO elastomer is suitable for the corrugated board cutting and scoring operations that are performed by the rotary die cutting apparatus 40.

There is something unusual and counter-intuitive about the scrap stripper 10 and how it is employed in the rotary die cutting apparatus 40. This relates to how the stripper 10 is mounted to the die board 52. The fingers 14, when mounted to the die board 52, are angled forwardly in the direction of rotation of the rotary cutting cylinder 50. This is particularly illustrated in FIG. 4. This is opposite to the angular orientation of the fingers shown in the scrap stripper in U.S. Pat. No. 7,111,534.

Figure 4:
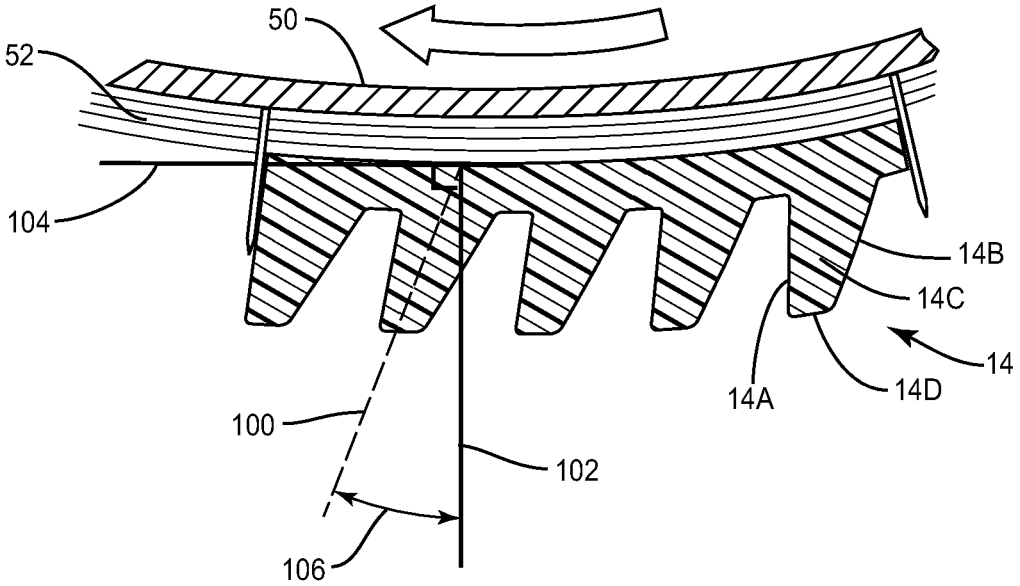
FIG. 4 is a fragmentary sectional view showing a scrap stripper secured to the base or die board of a die cylinder and which illustrates the forward angles formed by the fingers relative to a normal reference line.

The angular orientation of the fingers 14 are described herein and shown in the drawings. In some cases, the forwardly angled orientation is referred to by describing the fingers as projecting from the base at an incline and as being slanted forwardly in the direction of rotation of the rotary cutting die. See FIG. 4. In other cases, the description calls for forwardly angling a scrap stripper finger from the rotary cutting die in the direction of rotation of the rotary cutting die. When describing the angular orientation of the finger or fingers of the scrap stripper 10, the description is being made when the finger or fingers are disengaged such as shown in FIG. 4.

To assist in further defining these terms, a number of reference lines and at least one angle may help fully appreciate and understand the angular orientation of the fingers 14. With particular reference to FIG. 4, there is a finger angle line that is referred to by the numeral 100. The finger angle line 100 is a reference line that extends to or through a point on the outer surface of the die board 52 and bisects finger 14 when the finger is disengaged. See finger angle line 100. A second reference line is referred to as a normal reference line 102. Normal reference line 102 is a reference line that extends from or through the same point on the outer surface of the die board and which extends normal or perpendicular to a tangent line 104 that extends through the same point and extends tangential to the die board 52. As seen in FIG. 4, the finger angle line 100 and the normal reference line 102 form an angle. This angle is referred to as the forward finger angle 106. The term "forward finger angle" indicates that the angle is formed forwardly of the normal reference line and on the side thereof facing the direction of travel of the cutting cylinder 50 and die board 52.

The forward finger angle 106, in a preferred embodiment, is at least 10 degrees. A typical range for the forward finger angle 106 is approximately 10 degrees to approximately 40 degrees. In one embodiment, the forward finger angle 106 is approximately 15 to approximately 30 degrees.

Figure 5A:
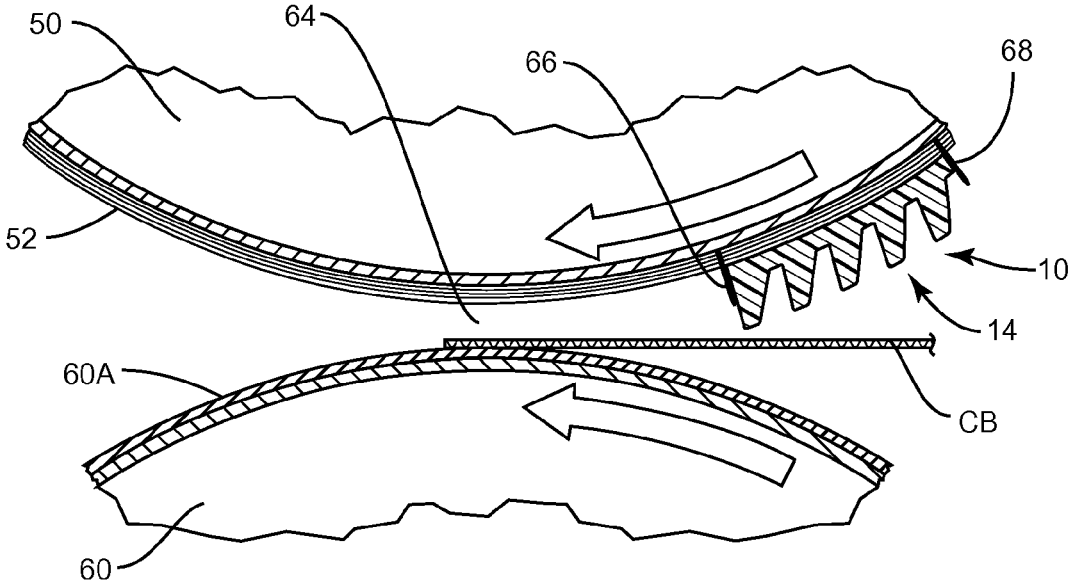
FIG. 5A is a partial sectional view of the corrugated board rotary die cutting apparatus incorporating the resilient scrap strippers of the present invention and which illustrates the relative positioning and orientation of the scrap strippers and incoming corrugated board material prior to cutting.

Turning to FIGS. 5A-5E, it is seen that in FIG. 5A the corrugated board CB is entering the nip 64. At this point the scrap stripper 10 and the individual fingers 14 thereof are disengaged and fully extended. Here the fingers 14 are disposed at the forward finger angle 106. That is, all of the fingers are inclined and slanted in a forward direction relative to the normal reference line 102 and the direction of rotation of the cutting die.

Figure 5B:
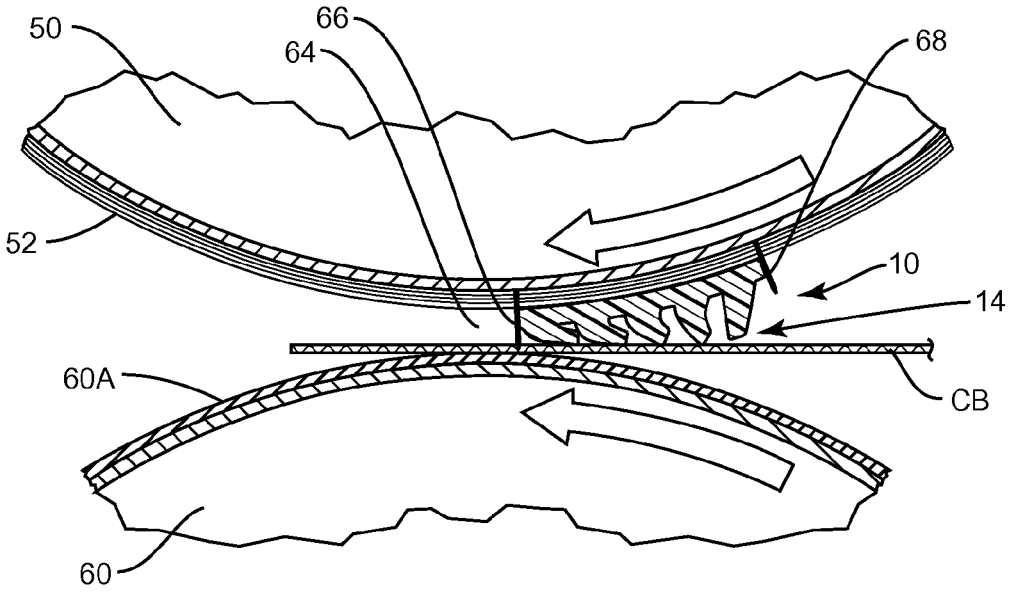
FIG. 5B is a partial sectional view similar to FIG. 5A but which illustrates the scrap stripper entering the nip between the rotary cutting die and the anvil

FIG. 5B shows the stripper 10 entering the nip 64. Note that the leading scrap cutting blade 66 has engaged the corrugated board and cut through the same. The leading fingers 14 of the scrap stripper 10 have advanced to the point where they engage the corrugated board CB. Even though the fingers 14 are angled forwardly in the direction of travel of the die board 52, the engagement of the fingers 14 with the corrugated board will cause the fingers to bend back as shown in FIG. 5B. This will effectively result in at least an upper portion of the fingers moving back in a direction opposite the direction of travel and will result in at least an upper portion of the individual fingers, in a preferred embodiment, passing through and past the normal reference line 102.

Figure 5C:
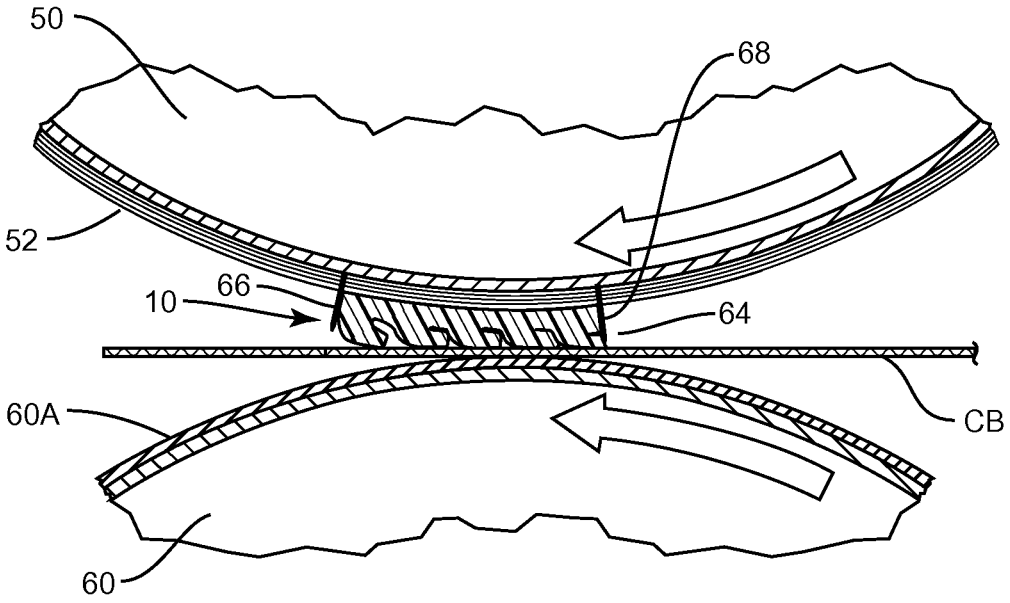
FIG. 5C is another sequence view illustrating a series of fingers forming a part of the scrap stripper being compressed between the die board and a cut piece of scrap as the scrap stripper moves through the nip.

In FIG. 5C, one sees that the scrap stripper 10 has further advanced through the nip 64 and in this case, all of the fingers 14 of this particular stripper 10 have engaged the corrugated board CB and are at least slightly bent backwards. The trailing scrap blade 68 is about to engage and cut through the corrugated board CB.

Figure 5D:
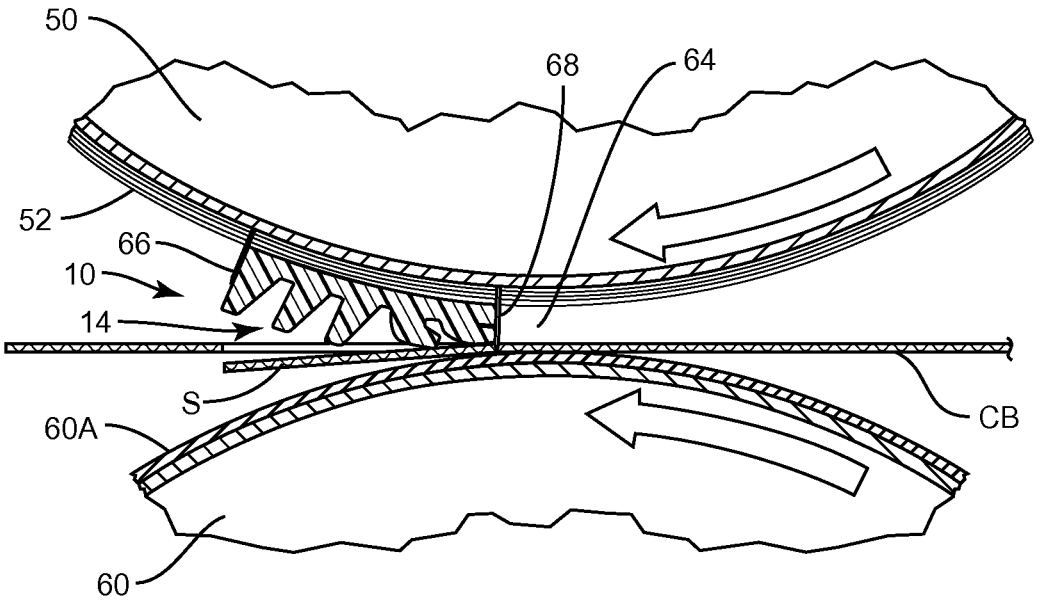
FIG. 5D is another sequence view of the rotary cutting die apparatus incorporating the resilient scrap stripper of the present invention which illustrates the "spring back" action of the fingers as the fingers hold the severed scrap against the rotating anvil.

In FIG. 5D, the trailing scrap blade 68 has cut through the corrugated board CB and the resulting cut piece of scrap S is essentially free of the product board. Also in FIG. 5D, it is seen that a number of the leading fingers 14 of the stripper 10 have become disengaged from the corrugated board CB or the scrap piece S and are fully extended while other trailing fingers 14 still engage the cut piece of scrap S. Also in FIG. 5D, it is seen where the cut piece of scrap starts to fall away from the product board.

Figure 5E:
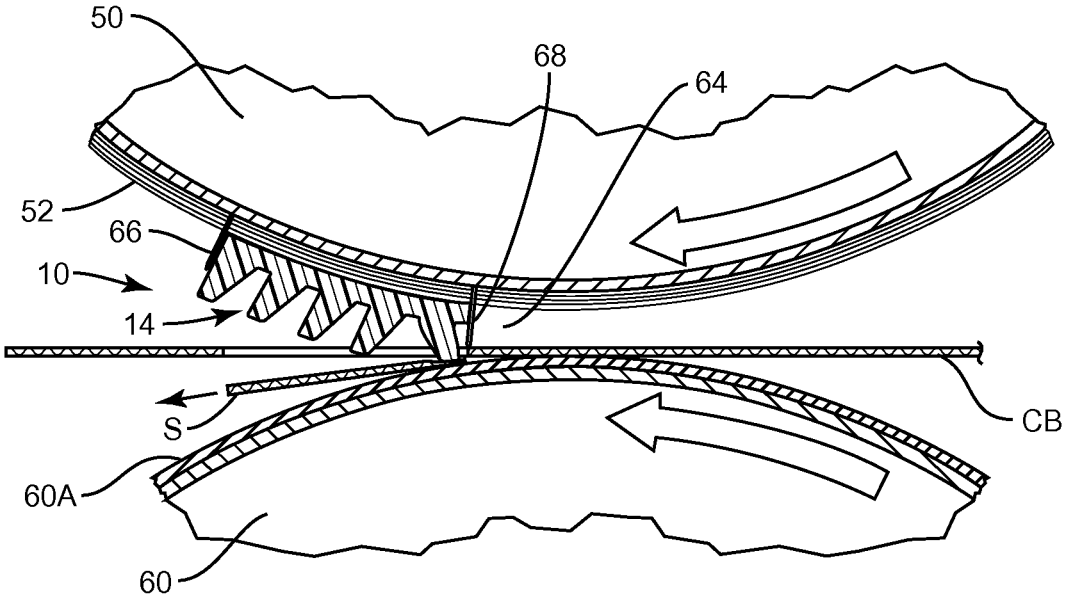
FIG. 5E is another sequence view of the rotary cutting die apparatus which further illustrates the "spring back" action of a number of the fingers and illustrates the cut piece of scrap being directed generally downwardly in front of the anvil.

FIG. 5E illustrates the stripper 10 exiting the nip 64. At this point, all of the fingers 14 except one have sprung back to the normal non-engaged and forwardly angled position. Only the trailing or last finger 14 has not reached the normal disengaged and forwardly angled position. Here the cut piece of scrap S is being directed away from the product board. More particularly, after being cut, the fingers have effectively directed the cut piece of scrap S against the surface of the rotating anvil 60 and, hence, the cut scrap S is being directed downwardly and forwardly of the anvil 60.

Turning to FIGS. 6 and 7, an alternate design is shown for the scrap stripper. In this case, the scrap stripper is referred to generally by the numeral 70 and includes a single finger 74 as opposed to the multiple fingers of the embodiment illustrated and discussed above. The scrap stripper 70 includes a base 72 and a finger indicated generally by the numeral 74. Finger 74 includes a leading end 74A, a trailing end 74B, a pair of sides 74C and an outer portion or tip 74D. Material for stripper 70 is typically 55-75 Shore OO elastomer, such as EPDM.

Scrap stripper 70 shown in FIG. 6 is depicted in FIG. 7 mounted to the die board 52 which is in turn mounted on the die cutting cylinder 50. Note the angular orientation of the finger 74 relative to the direction of rotation of the die board 52. Like the embodiment illustrated above, the finger 74 assumes an inclined and forwardly angled orientation relative to the direction of rotation of the die board 52. FIG. 7 also illustrates the orientation of the finger 74 relative to the reference lines discussed above. Note in FIG. 7 the forward finger angle 106 formed by the finger angle line 100 and the normal reference line 102.

In any event, the scrap stripper 74 shown in FIGS. 6 and 7 can be applied to strip scrap from adjacent scrap cutting blades in the same manner discussed above with respect to the first embodiment. The scrap stripper 74 can be applied singularly or in groups and can be used to strip any type of scrap, including trim or material that is cut from the product board. To clearly illustrate the reference lines 100, 102 and 104, the scrap cutting blades mounted on the die board 52 in FIG. 7 are not shown. It is understood and appreciated that there would be scrap cutting blades typically mounted on the leading and trailing sides of the scrap stripper 74 or on the leading and trailing sides of a group of scrap strippers 74.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of cutting and stripping a piece of scrap from a sheet of corrugated board passing between a rotary cutting die and an anvil where the rotary cutting die is rotated in one direction, comprising:

directing the sheet of corrugated board through a nip area defined between the rotary cutting die and the anvil;

cutting the piece of scrap from the corrugated board with a scrap cutting blade as the corrugated board passes through the nip;

engaging the cut piece of scrap with a scrap ejector secured to the rotary cutting die and comprising an elongated piece of resilient and compressible material that includes a base and a series of spaced apart forwardly angled fingers projecting from the base where each finger includes a leading end and a trailing end;

positioning the scrap stripper on the cutting die such that the fingers and the leading ends of the fingers are angled forwardly from the cutting die in the direction of rotation of the rotary cutting die such that in a disengaged position the fingers and the leading ends thereof are angled forwardly in the direction of the rotation of the rotary cutting die;

engaging the forwardly angled leading ends of the fingers with the cut piece of scrap and causing the forwardly angled fingers to bend back and project in a direction away from the direction of rotation of the rotary cutting die resulting in the fingers being compressed in the nip and resulting in the piece of scrap being held between the leading end of the fingers and the anvil; and as the rotary cutting die and anvil rotate and the cut piece of scrap emerges from the nip, releasing the bent back fingers allowing the fingers to spring forwardly to a forwardly angled position relative to the rotary cutting die and in the process stripping the piece of scrap from the scrap cutting blade and directing the piece of scrap away from the nip and away from the rotary cutting die and anvil.

2. The method of claim 1 including passing the forwardly angled fingers through the nip and engaging the piece of scrap with the fingers and wherein as the fingers enter and pass through the nip, each finger moves from the forwardly angled position past a normal reference line and is bent back such that the finger generally points in a direction opposite the direction of rotation of the rotary cutting die and wherein, after passing through the nip and engaging and urging the piece of scrap away from the rotary cutting die and anvil, each finger uncurls and passes forwardly past the normal reference line to the forwardly angled position.

3. The method of claim 1 wherein the rotary cutting die includes a die board and wherein each of the fingers form a forward finger angle with respect to the die board of approximately 10 °to approximately 40°.

4. The method of claim 1 wherein each finger of the scrap stripper forms a forward finger angle of 10 °to 40 °where the forward finger angle is defined by a finger angle reference line and a normal reference line and wherein the forward finger angle is formed forwardly of the normal reference line and on the side thereof facing the direction of rotation of the rotary cutting die.

5. The method of claim 1 wherein the scrap stripper includes opposed edges including one edge from which the fingers project and wherein the one edge includes a series of segments that extend between consecutive fingers, and wherein at least a portion of each angled finger projects over a segment that extends between two consecutive fingers.

6. An apparatus configured to cooperate with a rotating anvil to cut corrugated board comprising: a rotary cutting die including a rotating curved die board rotateable in one direction and configured to cooperate with the anvil to cut corrugated board passing through a nip defined between the die board and the anvil; the die board having at least one scrap cutting blade mounted thereon for cutting a piece of scrap from the corrugated board that is directed through the nip; a scrap stripper mounted to the die board adjacent the scrap cutting blade for stripping the piece of scrap from the scrap cutting blade and for urging the piece of scrap against the anvil as the piece of scrap exits the nip; the scrap stripper including a base and one or more forwardly angled fingers with each finger including a leading end and a trailing end and constructed of resilient and compressible material; each finger and the leading end of each finger in a disengaged position being angled forwardly relative to the die board and the direction of rotation of the die board; wherein as each forwardly angled finger enters the nip, the leading end of each finger engages the piece of scrap and presses the piece of scrap against the anvil such that the piece of scrap is sandwiched between the leading end of each finger and the anvil; and wherein as each finger exits the nip, the finger becomes disengaged with the piece of scrap and returns to the disengaged position with the finger and leading end of the finger being angled forwardly relative to the die board and the direction of rotation of the die board.

7. The apparatus of claim 6 wherein the one or more fingers are oriented on the die board such that outer portions of the one or more fingers curl back as the one or more fingers engage the piece of scrap and pass through the nip.

8. The apparatus of claim 6 wherein each finger forms a forward finger angle with respect to the die board and wherein the forward finger angle of each finger is 10 °to 40°.

9. The apparatus of claim 8 wherein the forward finger angle is defined by a finger angle line and a normal reference line and wherein the forward finger angle is formed forwardly of the normal reference line and on the side thereof facing the direction of rotation of the die board.

* * * * *